US006395059B1

(12) United States Patent
Zamalloa et al.

(10) Patent No.: US 6,395,059 B1
(45) Date of Patent: May 28, 2002

(54) SITU DESULFURIZATION SCRUBBING PROCESS FOR REFINING BLISTER COPPER

(75) Inventors: Manuel Zamalloa, Sainte-Anne de Bellevue; Yvan Tremblay, Ville Lasalle; Pascal Coursol, Mirabel; Eva Carissimi, Rouyn-Noranda, all of (CA)

(73) Assignee: Noranda Inc., Toronto (CA)

( * ) Notice: Subject to any disclaimer, the term of this patent is extended or adjusted under 35 U.S.C. 154(b) by 0 days.

(21) Appl. No.: 09/810,737

(22) Filed: Mar. 19, 2001

(51) Int. Cl.[7] ..... C22B 15/14
(52) U.S. Cl. ..... 75/650; 75/651
(58) Field of Search ..... 75/650, 651

(56) References Cited

U.S. PATENT DOCUMENTS

| | | | | |
|---|---|---|---|---|
| 3,262,773 A | | 7/1966 | Fritze | 75/650 |
| 3,561,952 A | | 2/1971 | Greenberg | 75/645 |
| 4,005,856 A | | 2/1977 | Themelis et al. | 266/161 |
| 4,034,063 A | | 7/1977 | Rosar et al. | 75/429 |
| 4,055,415 A | | 10/1977 | Stefän et al. | 75/641 |
| 4,211,553 A | | 7/1980 | Honkaniemi et al. | 75/525 |
| 4,316,742 A | * | 2/1982 | Canning, Jr. et al. | 75/650 |
| 4,504,309 A | | 3/1985 | Mackey et al. | 75/627 |
| 4,615,729 A | * | 10/1986 | Victorovich et al. | 75/641 |
| 5,180,422 A | | 1/1993 | Kikumoto et al. | 75/644 |
| 5,364,449 A | * | 11/1994 | Nakamura et al. | 75/650 |
| 5,516,498 A | | 5/1996 | Van der Wal et al. | 423/244.02 |
| 5,849,061 A | | 12/1998 | Themelis et al. | 75/638 |

OTHER PUBLICATIONS

C. T. Eddy, "Arsenic Elimination in the Reverberatory Refining of Native Copper", Transactions of the Metallurgical Society of the American Institute of Mining and Metallurgical Engineers, vol. 96 (1931), pp. 104–118. no month.

Themelis, N.J., "Injection Refining of Directly–Smelted Copper", International Symposium on Injection in Process Metallurgy, TMS Minerals, Metals and Materials Society (1991), pp. 229–251 no month.

Stapurewicz, T.T., and Themelis, N.J., "Removal of Antimony from Copper by Injection of Soda Ash", Metallurgical Transactions, vol. 21B (1990), p. 967, no month.

P. Taskinen, "Distribution Equilibria of As, Bi, Cu, Pb and Sb between Molten Copper and Soda at 1200° C.", Scandinavian Journal of Metallurgy, vol. 11 (1982), pp. 150–154. no month.

J. G. Peacey, G. R. Kubanek, and P. Tarrassoff, "Arsenic and Antimony Removal from Copper by Blowing and Fluxing", 109th AIME Annual Meeting, Las Vegas, Nevada, Feb. 1980.

Riveros, G.A., Salas, R.I, Zuniga, J.A., and Jimenez, O.H., "Arsenic Removal in Anode Refining by Flux Injection", Mining in America, Institute of Mining & Metallurgy, Chatman & Hall, London, 1994 no month.

T. Nakamura, Y. Ueda, F. Noguchi and J. M. Toguri, "The Removal of Group VB Elements (As, Sb, Bi) from Molten Copper Using a Na2CO3 Flux", Canadian Metallurgical Quarterly, vol. 23, No. 4, pp. 413–419, 1984 no month.

* cited by examiner

*Primary Examiner*—Roy King
*Assistant Examiner*—Tina McGuthry-Banks
(74) *Attorney, Agent, or Firm*—Goudreau Gage Dubuc

(57) ABSTRACT

A novel process for refining high or low impurity blister copper containing S, As, Sb, Pb, Ni, Bi, Se, and/or Te to anode quality by means of a solution containing sulphates and alkali oxides is provided. More specifically, the process comprises the steps of (1) injecting air/$O_2$ gas mixtures in the presence of an alkali source, over a period of time sufficient to complete the sulphur removal stage, with the innovation of removing the $SO_2$ in situ, thereby forming an effective amount of a molten alkali sulphate on top of the copper bath, the temperature in the bath being maintained between 1100–1300° C.; (2) adding and/or injecting molten or solid alkali sulphates together with basic oxides or carbonates into the copper bath to promote the in situ scrubbing of As and Sb into a solution containing sulphates, while the dissolved oxygen in copper increases from 0.1 to 0.6 wt %; (3) increasing the level of oxygen in the copper to remove the remaining impurities into a molten solution of $Cu_2O$ and/or $Cu_2O$—CaO, while the molten sulphate and oxide phases co-exist as two immiscible liquid layers of slag; and (4) skimming both the sulphate and oxide slag layers prior to commencing de-oxidation.

10 Claims, 3 Drawing Sheets

SITU DESULFURIZATION SCRUBBING PROCESS FOR REFINING BLISTER COPPER

FIELD OF THE INVENTION

The present invention relates to a process for refining high impurity blister copper to anode quality. The process utilises alkali oxides and a solution containing sulphates to effectively remove sulphur and other impurities, such as As and Sb as well as Pb, Ni, Bi, Se and Te, from blister copper.

BACKGROUND OF THE INVENTION

The production of blister copper from copper sulphide concentrates can be accomplished using two main pyrometallurgical systems: flash-smelting and bath-smelting. The number of stages within each system may vary from a single stage copper production to two stage smelting and converting processes.

A conventional two-stage smelting and batch converting process has the following major disadvantages: (i) the process is not energy efficient; (ii) the slag must be periodically skimmed from the converter; and (iii) the matte produced in the smelting furnace must be physically transferred to the converter furnace. During this transfer, high levels of fugitive emissions of $SO_2$ are generated. Due to these drawbacks, there is a need to develop environmentally acceptable single stage smelting and converting systems that are both cost-efficient and energy-efficient.

Single stage blister copper production systems offers environmental and energy-efficiency advantages over the conventional two-stage copper smelting and batch converting processes. The Noranda continuous smelting and converting process is capable of producing blister copper from chalcopyrite concentrates in a single vessel. Likewise, the Noranda continuous converter is able to produce blister copper from mixtures of liquid and solid matte as well as from slag and copper concentrates. The Outokumpu flash smelting process can also produce blister copper from chalcocite concentrates in a single stage.

A significant drawback of all single-stage copper production systems is that they produce blister copper containing high levels of impurities, specifically sulphur, arsenic, antimony, and bismuth (e.g. ,1.3 wt % S, 0.5 wt % As, 0.5 wt % Sb, 0.03 wt % Bi). By comparison, blister copper produced in a conventional two-stage copper smelting and batch-converting process typically contains about 0.02–0.1 wt % sulphur, and only trace amounts of precious and other minor elements. However, as the grade and quality of copper ores decreases with time, even blister copper from conventional two-stage smelting-converting processes may contain high levels of these undesirable elements. Thus, in both cases, to produce molten "anode quality" copper, an extra "blister copper refining" stage is needed.

Blister copper refining, which is the subject of this invention, is conventionally carried out in three steps: i) de-sulfurization; ii) fluxing-skimming; and iii) de-oxidation. In the first step, batches of molten blister copper are introduced into modified Pierce Smith converters or cylindrical "anode furnaces". Oxygen-enriched air is injected to remove the sulphur as $SO_2$. As the sulphur content is lowered to about 0.003 wt % sulphur, the oxygen content reaches a level of about 0.8 wt %. Fluxing is practised by injecting basic materials such as mixtures of soda ash-CaO to combine with the acidic oxides of As and Sb, forming a slag that must be removed from the vessels prior to commencing de-oxidation. The oxidised molten copper thus produced is then de-oxidised to an oxygen level of about 0.1 wt % by injecting a reducing gas, such as natural gas.

Currently, various copper refining techniques exist for removing some of the impurities. The removal of arsenic by soda ash fluxing at about 1 wt % oxygen dissolved in copper is discussed by Eddy (1). The effectiveness of using soda ash fluxing to remove As and Sb is also described by Themelis (2). Stapurewicz et al. (3) provides a study of the thermodynamics of Sb removal from blister copper by soda ash fluxing. Taskinen (4) describes the distribution equilibrium of As, Sb and Bi between copper and soda ash. Peacey et al. (5) discusses the equilibria resulting from fluxing copper with soda ash and limestone. Riveros et al. (6) describes kinetic aspects observed during the operation and optimisation of the soda ash fluxing process practised at the Chuquicamata smelter.

In U.S. Pat. No. 3,561,952, the use of alkali oxide-silicate slags as well as alkali oxide phosphates and/or borates for the removal of lead and tin from copper scrap is described. In U.S. Pat. No. 3,262,773, a refining process for the removal of arsenic, antimony, tin and other acidic oxide forming elements from molten copper is presented. It teaches that removal may be accomplished by combining the acid oxides of such elements with basic materials such as alkaline earth oxides, in particular $CaF_2$ and CaO, present in the slag. This patent suggests the use of 4 to 12 wt % calcium oxide based on the weight of the crude copper while the process temperature is maintained at between 1250 and 1300° C. U.S. Pat. No. 4,316,742 describes a method of refining copper by melting the copper scrap in the presence of a flux that comprises a mixture of calcium oxide and sodium oxide in a weight ratio of $CaO/Na_2O$ of from 1:1 to 4:1 while bubbling oxygen into the copper bath. A process for the production of high-grade copper from an inexpensive starting material such as blister copper or copper scraps by adding a mixture of CaO and other oxides is disclosed in U.S. Pat. No. 4,055,415. U.S. Pat. No. 4,211,553 presents a method and apparatus for refining a melt using a pulverous solid material and a carrier gas, where the solid material may be CaO. U.S. Pat. No. 5,849,061 describes a stepwise injection of mixtures of air, oxygen and $Na_2CO_3$ followed by a simultaneous injection of hydrocarbons and $SF_6$ as a process for refining high-impurity copper to anode quality copper.

While the above methods relating to the use of alkali oxides for the removal of impurities from molten copper have been described, they are not used in combination with a solution containing sulphates.

The concept of scrubbing $SO_2$ and forming sulphates in pyrometallurgical systems is not new. For example, U.S. Pat. No. 4,034,036 describes a process for controlling $SO_x$ emissions from copper smelter operations involving pyrometallurgical reduction of copper ores to elemental copper, in which the gases from reverberating furnaces, roasters, and/or converters are scrubbed with a sodium alkali sorbent to produce sodium sulphate and sulphite wastes. This patent teaches the scrubbing of $SO_2$ in flue gases. Conventional wet or dry scrubbing of $SO_2$ in flue gases using sodium alkali, either using a regeneration type of scrubbing or a double alkali process, presents high capital and operating costs as well as environmental issues involving the disposal of a thixotropic sludge of the end product (i.e., calcium sulphate-sulphide).

A copper flash smelting process in which part of a sulfidic copper feed is roasted in the presence of a calcareous $SO_2$ scavenger to produce a calcine containing calcium sulphate and an oxidic copper product is described in U.S. Pat. No. 4,615,729. This is referred to a sulphate roasting process where the sulfidic copper material is roasted at a temperature of about 850 to 1000° C. The well-mixed feed therein is reacted with air to provide a calcine comprised mainly of solid calcium sulphate and copper ferrite and an off-gas rich in $CO_2$ and poor in $SO_2$. Thus, the concept of using an $SO_2$ scavenger selected from the group of lime and limestone is established.

U.S. Pat. No. 5,180,422 describes a copper smelting process in which copper concentrates are smelted in a furnace to produce purified copper. The flue gases may be exhausted from either or both of a smelting furnace and a converting furnace, and gypsum may preferably be introduced into the converting furnace. In this process, the gas discharged from the furnace is treated to produce sulphuric acid. Gypsum is produced from the waste liquid treatment produced at the acid plant. Gypsum is recirculated to the converting furnace where it decomposes according to the reaction $CaSO_4=CaO+SO_2+\frac{1}{2}O_2$. This approach is consistent with process slag chemistry since a source of lime is needed to produce a calcium ferrite slag, but the sulphate itself is not used to remove impurities from the melt.

Existing techniques for removing impurities from blister copper using mixtures of alkali oxides and/or carbonates have exhibited several disadvantages, including: i) excessive emissions of $SO_2$ and volatile species like As and Pb during the sulphur removal and fluxing stages; ii) excessive refractory wear and unacceptable vessel mouth erosion that takes place during slag skimming; and iii) high cost of reagents. Therefore, there is a need to develop environmentally acceptable and cost-effective processes capable of effectively removing not only As and Sb, but also other impurities like Pb, Ni, and Bi from both low and high impurity blister copper. Accordingly, there is a great need for a simple process for refining blister copper, reducing to a minimum $SO_2$ and volatile emission generation during the sulphur removal and fluxing stages, while shortening the process cycle. The most preferable result is a single stage sulphur and impurity removal process, wherein the $SO_2$ and volatile components are removed in situ. Such a process would certainly be of great benefit to the industry, because the soda ash based system could be replaced with a sulphate based slag system, the latter producing significantly fluid slag at lower temperatures and lower refractory attack ability.

The contents of the following above-mentioned references are incorporated herein by reference: (1) C. T. Eddy, "Arsenic Elimination in the Reverberatory Refining of Native Copper", Transactions of the Metallurgical Society of the American Institute of Mining and Metallurgical Engineers, Vol. 96 (1931), pp. 104–118. (2) Themelis, N. J., "Injection Refining of Directly-Smelted Copper", International Symposium on Injection in Process Metallurgy, TMS Minerals, Metals and Materials Society (1991), pp. 229–251. (3) Stapurewicz, T. T., and Themelis, N. J., "Removal of Antimony from Copper by Injection of Soda Ash", Metallurgical Transactions, Vol. 21B (1990), p. 967. (4) P. Taskinen, "Distribution Equilibria of As, Bi, Cu, Pb and Sb between Molten Copper and Soda at 1200° C.", Scandinavian Journal of Metallurgy, Vol. 11 (1982), pp. 150–154. (5) J. G. Peacey, G. R. Kubanek, and P. Tarrassoff, "Arsenic and Antimony Removal from Copper by Blowing and Fluxing", 109$^{th}$ AIME Annual Meeting, Las Vegas, Nev., February 1980. (6) Riveros, G. A., Salas, R. I., Zuniga, J. A., and Jimenez, O. H., "Arsenic Removal in Anode Refining by Flux Injection", Mining in America, Institute of Mining & Metallurgy, Chatman & Hall, London, 1994. The contents of the following are also incorporated herein by reference: (7) T. Nakamura, Y. Ueda, F. Noguchi and J. M. Toguri, "The Removal of Group VB Elements (As, Sb, Bi) from Molten Copper Using a $Na_2CO_3$ Flux", Canadian Metallurgical Quarterly, Vol. 23, No. 4, pp. 413–419, 1984.

The contents of the following list of U.S. Patents are incorporated herein by reference: U.S. Pat. Nos. 3,561,952; 3,262,773; 4,316,742; 4,055,415; 4,211,553; 5,849,061; 4,034,063; 4,615,729; 5,180,422; 5,516,498; 4,005,856; and 4,504,309.

SUMMARY OF THE INVENTION

In accordance with the present invention, there is now provided a novel process for refining high or low impurity blister copper using a solution containing molten sulphates. More specifically, the present invention comprises the steps of:

(a) Sulphur removal by injecting air/$O_2$ gas mixtures into molten blister copper in the presence of an alkali source, over a period of time sufficient to complete the sulphur removal stage, with the innovation of removing the sulphur in situ, forming an effective amount of a molten alkali sulphate on top of the copper bath, the temperature in the vessel being maintained between 1100–1300° C.

(b) Simultaneously injecting a solid alkali sulphate and/or basic oxide into the melt to promote the oxidation/fluxing (in situ scrubbing) of As and SB into a solution containing sulphates while the dissolved oxygen in copper increases from 0.1 to 0.6 wt %.

(c) Increasing further the level of oxygen in copper to about 1 wt % to further remove Sb, Pb, Ni and Bi by fluxing them into a molten solution of $Cu_2O$ and/or $Cu_2O$—CaO. The copper oxide and $Cu_2O$—CaO solution are stable with the sulphate phase and two immiscible liquid layers coexist in the vessel at the temperature of the process.

(d) Skimming the sulphate and oxide slag layers separately or together prior to commencing de-oxidation. The slags produced must be efficiently removed before reduction to avoid reversion of impurities back into the copper during the reduction phase.

DETAILED DESCRIPTION OF THE INVENTION

Figure 1:
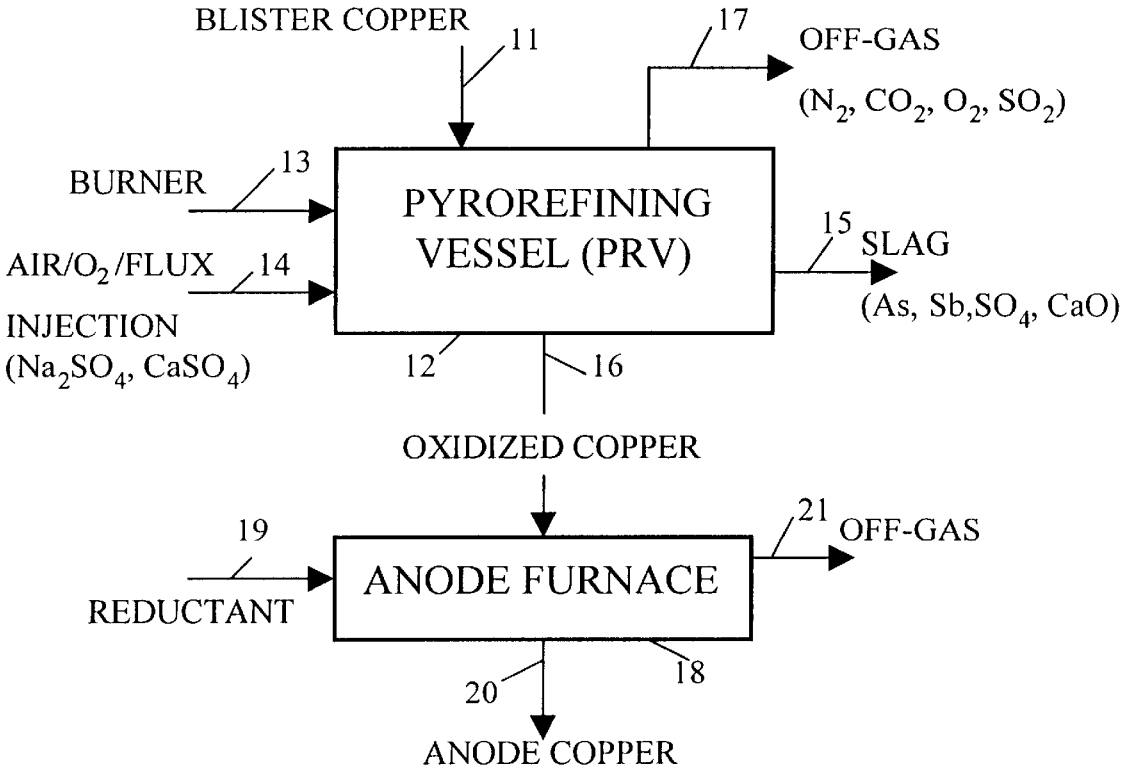
FIG. 1 is a block diagram illustrating the process of the present invention.

It is an object of the present invention to provide a single stage process for removing impurities from blister copper and/or molten copper containing impurities, and which can effectively fix $SO_2$ emissions and other volatile gases into a solution containing sulphates.

The invention relates to a process for the pyrometallurgical refining of high or low impurity blister copper by forming a sulphate containing solution while desulfurizing and oxidising the charge, and then subjecting the resultant treated charge to slagging to complete the refining of other minor elements.

The present invention comprises the use of an initial amount of a sulphating agent, either before or during the desulfurization process. Preferred alkali sources are:

solid alkali oxides ($Na_2O$, CaO)

solid-liquid alkali carbonates ($Na_2CO_3$, $CaCO_3$)

solid-liquid alkali binary or multicomponent salts or slags ($Na_2SO_4$, $CaSO_4$, $BaSO_4$, $K_2SO_4$, $Na_2O$—$SiO_2$, $Na_2O$—CaO, $Na_2O$—CaO—$SiO_2$)

The quantity of alkali source required may vary depending on the sulphur content of the melt. For example, if the copper contains 1 wt % of sulphur and if an alkali silicate is used, the quantity required may be greater than 5 wt % of the initial melt. Preferably, the amount of alkali source should vary in the range from 3.5 to 5 wt %, and most preferably from 1.75 to 3.5 wt %, based on the initial amount of blister copper. Overall, the quantity of alkali source to be used will depend on the stoichiometry and efficiency of the process.

The $SO_2$ is fixed into reaction products forming solid or liquid sulphate compounds and/or slags, and in some cases additional $CO_2$ gas according to the following reactions:

$$Na_2O+SO_2+0.5O_2=Na_2SO_4 \quad (1)$$

$$CaO+SO_2+0.5O_2=CaSO_4 \quad (2)$$

$$Na_2CO_3+SO_2+0.5O_2=Na_2SO_4+CO_2 \quad (3)$$

$$CaCO_3+SO_2+0.5O_2=CaSO_4+CO_2 \quad (4)$$

The fundamental principle is that under oxidising conditions, sulphur dissolves in oxide melts/glasses as sulphate. It is clear that under oxidation conditions, sulphates are formed from the reaction of $SO_2$ and the alkali-based oxide. Depending on the temperature of the process, the reaction product may be solid or liquid. Thermodynamically, a low temperature, high partial pressure of $SO_2$, and high oxygen potential will favour the formation of sulphates. Therefore, if pure oxygen is injected into a refining vessel containing a sulphating agent like CaO, the off-gas generation should be negligible; all the $SO_2$ will be adsorbed into a molten sulphate layer. The results imply that the theoretical oxygen demand for sulphur removal will be 0.5 times higher due to the reaction involved in the process as shown in reaction 2 (i.e. $CaO+SO_2+\frac{1}{2}O_2=CaSO_4$).

The key feature of the unexpected results obtained with the present process is the formation of stable molten sulphates from the sulphur contained in the melt and the ability of the molten sulphate solution to absorb As and Sb. Our experimental data has confirmed that calcium arsenates and calcium antimonates have great solubility in a $Na_2SO_4$—$CaSO_4$ slag system as compared to the copper oxide rich phase. Therefore the present single stage process is most advantageous for As and Sb removal into a molten sulphate slag. The mechanism of As and Sb removal can be described taking into account the following chemical reactions:

$$3CaSO_4+O_2+2[As]_{copper}=Ca_3As_2O_8+3SO_2 \quad (5)$$

$$3Na_2SO_4+O_2+2[As]_{copper}=2Na_3AsO_4+3SO_2 \quad (6)$$

$$3CaSO_4+O_2+2[Sb]_{copper}=Ca_3As_2O_8+3SO_2 \quad (7)$$

$$3Na_2SO_4+O_2+2[Sb]_{copper}=2Na_3SbO_4+3SO_2 \quad (8)$$

Arsenic and antimony removal from copper can also be enhanced by using an extra source of CaO either added directly of formed from exchange reactions according to the following reactions:

$$Na_2CO_3+CaSO_4=CaO+Na_2SO_4+CO_2 \quad (9)$$

$$3CaO+5[O]_{copper}+2[As]_{copper}=[Ca_3As_2O_8]_{sulphate} \quad (10)$$

$$3CaO+5[O]_{copper}+2[Sb]_{copper}=[Ca_3Sb_2O_8]_{sulphate} \quad (11)$$

where [ ] represents oxygen, impurity or salt dissolved in molten copper or molten sulphate phases.

The process of the present invention is illustrated in the drawing of FIG. 1, which schematically represents the treatment of blister copper 11 to produce anode copper 20. Blister copper 11 is charged into a pyrorefining vessel (PRV) 12. Without limiting the geometrical configuration, the PRV 12, which may be any convenient type of vessel (e.g., a modified cylindrical Pierce Smith converter or a vertical type of vessel like a ladle), is maintained at a temperature of about 1150 to 1300° C. using an auxiliary burner 13. Tuyeres or injectors 14 may be used to inject air/$O_2$ mixtures or solid fluxes (e.g., solid alkali oxides and/or sulphates) into the bath either continuously or at predetermined intervals. Absorption, oxidation and fluxing reactions takes place in the PRV 12 to produce (i) a slag 15 containing principally alkali sulphates, alkali oxides and copper oxide, (ii) refined copper 16, and (iii) an off-gas 17 containing mostly the products from the burner combustion (e.g., $N_2$, $O_2$, $CO_2$) and poor in or even devoid of sulphur dioxide. The refined copper 16, containing about 1 wt % oxygen, is then tapped as a product and fed into an anode furnace 18 to perform de-oxidation using a reductant 19 (e.g., $CH_4$) that generates an exhaust gas 21.

Figure 2A:
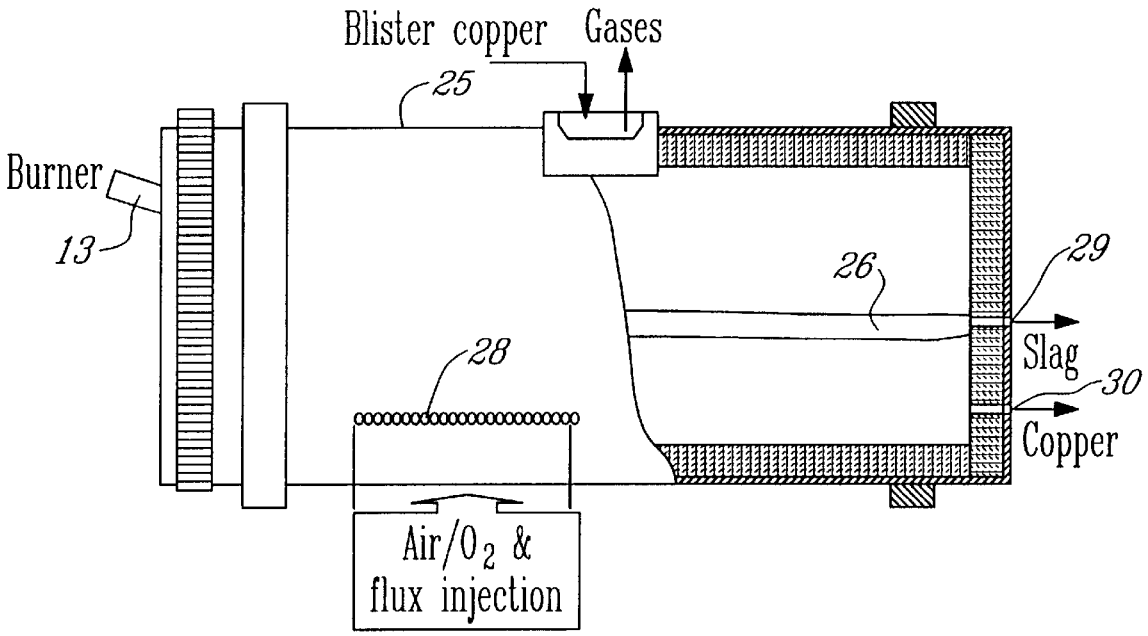
FIGS. 2A and 2B are drawings illustrating a pyrorefining vessel (modified Pierce Smith Converter) executing the blister copper refining process of the present invention.
Figure 2B:
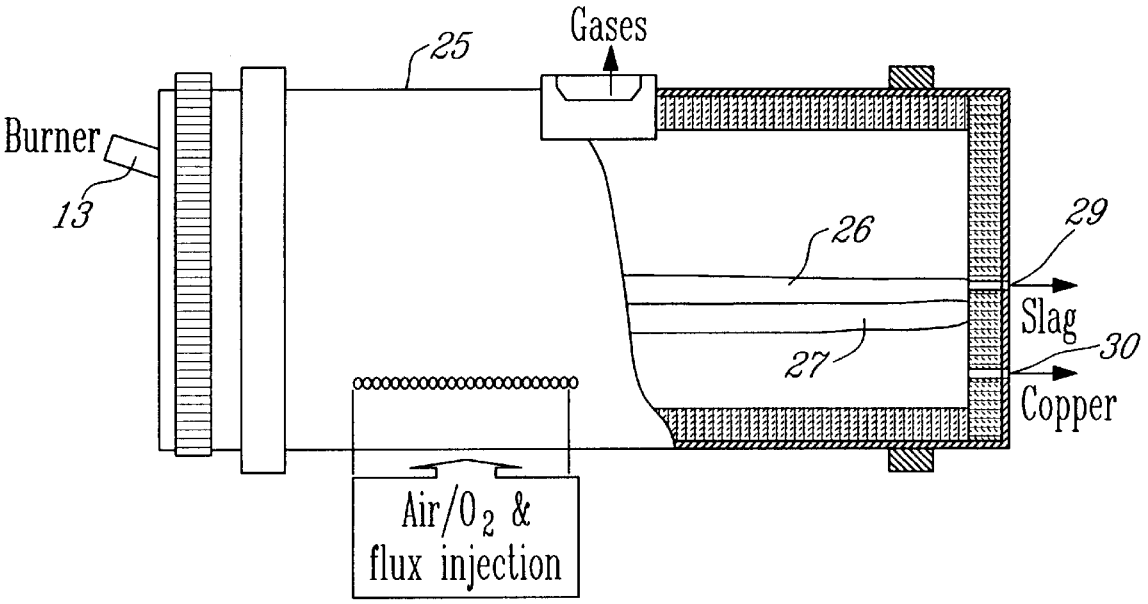

Referring to FIGS. 2*a* and 2*b*, one aspect of the present invention is a batch process using a cylindrical PRV 25 in which sulphur is removed into a sulphate slag 26 and the remaining impurities are removed in a subsequent oxidation fluxing step. Thus, a separate immiscible molten layer containing alkali oxides and copper oxide 27 co-exists with the sulphate layer, where the alkali oxides and sulphates are compounds of groups IA and IIA of the periodic table. Each step is carried out while the bath temperature is controlled, preferably at about 1220±10° C., on single batches of 150 MT of blister copper, while fluxes may be co-injected 28 into the bath at predetermined intervals at about 10 MT/hr using the quantities and flux ratios described above. The sulphur removal stage may last about 30 minutes, consuming about 2.8 MSCF of air per metric ton of copper. The gas requirements depend on the number of tuyeres/injectors used, % oxygen in the gas mixture, and oxygen utilisation efficiency.

According to the present invention, the first step of the process can be used to remove mostly sulphur. For this, an oxygen source, preferably a mixture of oxygen and nitrogen containing mostly oxygen, can be injected 28 into the sulphur-containing melt. The alkali sulphating agent can be injected together with the gas mixture to promote rapid absorption reactions, thereby effectively removing the sulphur into a sulphate slag. The sulphate slag formed or the refined copper can be separated out from the vessels using a batch, semi-continuous, or continuous method of operation via tapping holes 29, 30. Alternatively, if required, the oxidation of copper may continue in the presence of the molten sulphate layer 26 initially formed.

It is important to note that, in principle, the first step of the process of the present invention can also be used as an alternative method to fix $SO_2$ from smelting and converting off-gases in order to minimise $H_2SO_4$ production. For this purpose, the $SO_2$ produced can be conditioned to make it suitable for injection into a molten solution containing alkali oxides and carbonates. The molten solution should act as a mass transfer medium to sustain absorption reactions between the alkali sulphating agent and the $SO_2$, effectively producing a stable sulphate solution at high temperatures (i.e., approximately 1200° C.). It is thus distinguished from the process for the removal of sulphur dioxide from gases such as the one described in U.S. Pat. No. 5,516,498.

According to the invention, the second step of the process may be practised directly to treat molten copper containing impurities other than sulphur. The source may be molten copper scrap or blister copper previously desulfurized. In this case, a mixture of alkali oxides with sulphates may be added or co-injected, thereby causing the arsenic and/or antimony in the melt to slag in the form of compound of a basic salt of arsenate and antimonate. The temperature of the process, flux addition rates, and oxygen content in copper may be controlled accordingly to remove the thus formed slag from the melt as either a liquid or a solid.

The present invention can be carried out by any of the following:

(1) Adding/injecting a mixture of $Na_2SO_4$ and CaO. In this case, the role of the sodium sulphate is to enhance the reaction between lime and sulphur dioxide within a molten phase, thus $SO_2$ is fixed as $CaSO_4$.

(2) Adding/injecting mixtures of CaO and $Na_2CO_3$ during the sulphur removal stage to promote the in situ formation of a molten base slag of $Na_2SO_4$—$CaSO_4$ and then adding/injecting a sufficient amount of CaO to remove As and Sb. The percentage removal will depend on the CaO addition level. Since the sulphate slag produced is at low activity of copper oxide, as soon as the oxygen level in copper increases to saturation, two immiscible layers of slag co-exist. Thus, the formation of a CaO—$Cu_2O$ solution can be used to additionally enhance removal of Sb. During the last step, oxygen is fixed by the equilibrium between copper and copper oxide rich phase. The copper oxide formed is stable with the sulphate, this phase will also remove Pb, Ni and Bi.

(3) Adding and or co-injecting mixtures of $Na_2SO_4$—$CaSO_4$ and CaO to promote the direct in situ formation of a CaO-saturated $Na_2SO_4$—$CaSO_4$ base slag to remove As and Sb.

The weight ratio of $CaSO_4$:$Na_2SO_4$ should be preferably maintained at about 3:1 in order to produce a molten slag at about 1200° C. The operating temperature and amount of flux may be adjusted, depending on the level of impurities of the slag. The weight ratio of CaO:$CaSO_4$ may vary within the range of 1:3 to 1:2. This ratio may also be adjusted based on the quantity of impurities to be removed. Although the CaO content in the slag must be kept at its maximum activity to remove high levels of impurities like Sb, excess CaO saturation may affect the apparent viscosity of the slag, thus leading to slag quality issues.

The expression "desulfurization in situ scrubbing" should be interpreted as meaning that the sulphur, arsenic and antimony of the melt are absorbed from the molten blister copper into a solution containing alkali oxides and sulphates.

Based on the experimental data from laboratory and industrial tests available, the process of the present invention comprising steps (a) to (d) permits the efficient removal of impurity elements (S, As, Sb, Pb, Ni, Bi, Se, Te) from blister copper. Therefore, the present invention contributes to the effective industrial use of sulphate materials for copper refining.

Those skilled in the art will appreciate that the process of the invention, as described in conjunction with the drawings, can be varied substantially without departing from the ambit of the invention. For example, the present invention is applicable to any type of vessel where a "solution containing sulphates" is used as a high temperature scrubber to absorbe either $SO_2$ and/or impurities into a separate layer. The only basic criterion is that one of the condensed layers from a system containing 2, 3 or 4 condensed layers is a solution containing sulphates. For this purpose, the composition and thermodynamic conditions of the condensed layers (e.g. metal-slag, metal-matte-slag) may be adjusted to address stability conditions of the sulphate components. The advantage of using this approach is to directly produce a refined copper or to minimise the level of impurity input into the subsequent pyrorefining stage to produce anode copper. Thus, the process of the invention may be useful for adaptation into a single stage continuous smelting/converting vessels to produce blister copper, such as those described in U.S. Pat. No. 4,005,856, U.S. Pat. No. 4,504,309, or conventional batch and flash smelting converting vessels.

The following examples are provided for illustrating the present invention and should not be construed as limiting its scope.

EXAMPLE 1

Twelve kilograms of blister copper of the composition given at time zero were fed into an alumina crucible and kept molten using a laboratory-type resistance heating furnace. The sulphur removal stage was commenced by injecting a gas mixture of air/$O_2$, while adding simultaneously a mixture of 70 wt % CaO and 30 wt % $Na_2CO_3$. Soon after commencing desulfurization, a separate molten layer of sulphate appeared. The volume of the sulphate slag increased gradually in the first 115 minutes of the process. Overall temperature variation was recorded to be in the range of 1185–1209° C. The data clearly shows that as the in situ desulfurization takes place, As and Sb are also being absorbed into the sulphate slag while the oxygen in copper increases from 0.05 to 0.41 wt %. Once the sulphur removal stage is completed, and the oxygen in copper increases from about 0.6 wt % to 1.2 wt %, the formation of a separate immiscible layer of $Cu_2O$ will enhance lead removal. The distribution coefficients of As and Sb between the sulphate slag and copper were 2181 and 870 respectively. Likewise, the distribution coefficient of lead between the $Cu_2O$ slag and copper was 27. Distribution coefficient is defined as the ratio of the impurity content in the slag to impurity content in the metal phase.

TABLE 1

| ID | Time(min) | [O] | S | As | Sb | Pb |
|---|---|---|---|---|---|---|
| CaO 48-1 | 0 | | 7038 | 2458 | 2829 | 4739 |
| CaO 48-2 | 15 | | 5709 | 2350 | 2891 | 4904 |
| CaO 48-3 | 30 | | 4597 | 2068 | 2825 | 4665 |
| CaO 48-4 | 45 | | 3597 | 1425 | 2768 | 4591 |
| CaO 48-5 | 70 | | 2119 | 783 | 2513 | 4729 |
| CaO 48-6 | 85 | | 724 | 270 | 1498 | 4685 |
| CaO 48-7 | 100 | | 232 | 86 | 501 | 4772 |
| CaO 48-8 | 115 | | 51 | 18 | 61 | 4302 |
| CaO 48-9 | 130 | | 27 | 13 | 27 | 4180 |
| CaO 48-10 | 145 | | 27 | 13 | 27 | 4223 |
| CaO 48-11 | 170 | | 27 | 13 | 27 | 3992 |
| CaO 48-12 | 207 | | 27 | 13 | 27 | 2533 |
| CaO 48-13 | 267 | | 27 | 13 | 27 | 1144 |

Figure 3:
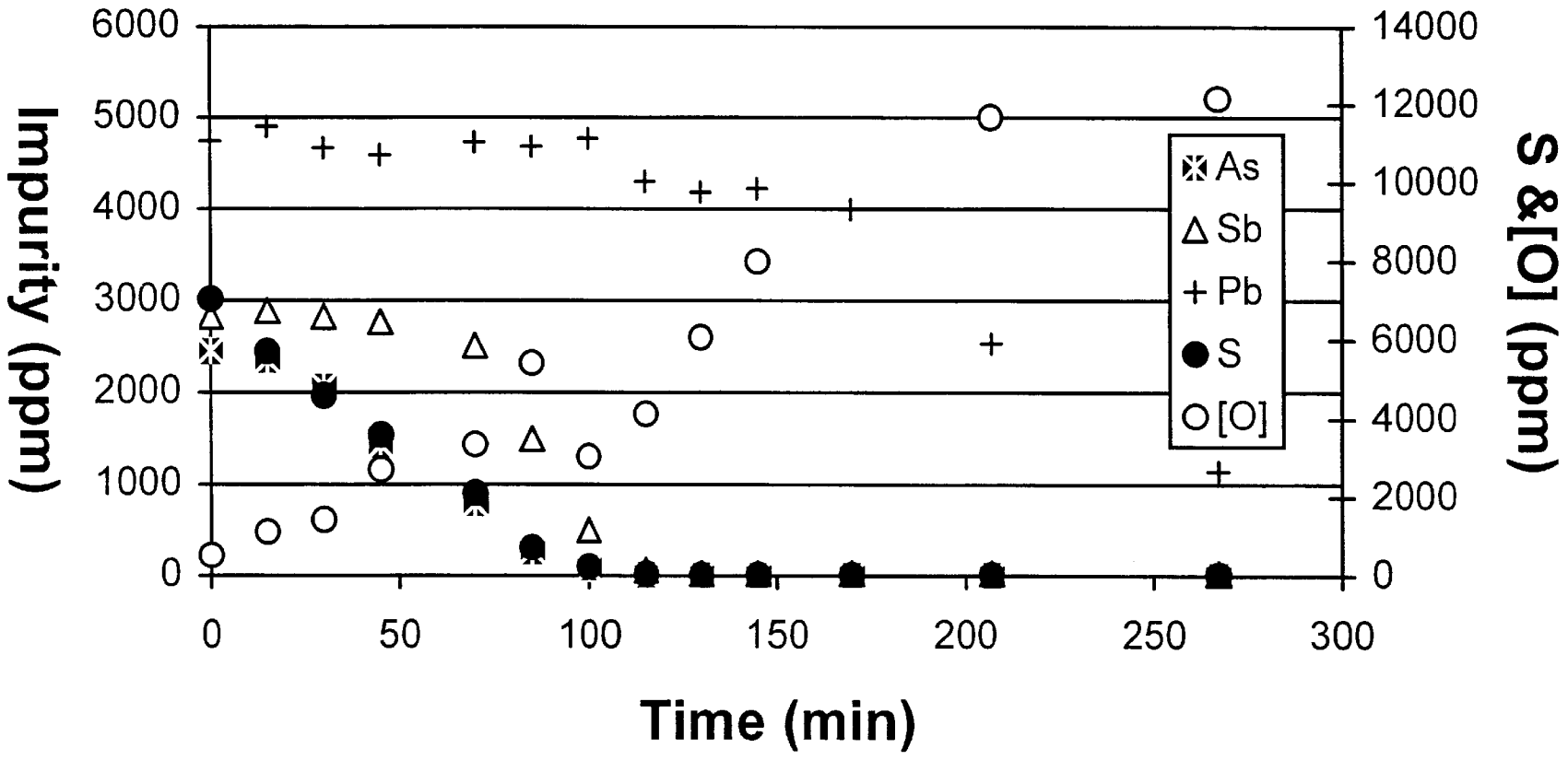
FIG. 3 is a graph illustrating the impurity vs time according to the data of Table 1 in Example 1.

FIG. 3 of the appended drawings illustrate the data of Table 1.

EXAMPLE 2

This example is provided to show that adding a mixture of $Na_2SO_4$ and CaO during the sulphur removal stage while injecting pure $O_2$ can in fact promote the in-situ formation of a molten base slag of $Na_2SO_4$—$CaSO_4$ without off-gas generation. In this experiment, the temperature of the melt varied from 1190 to 1213° C. As shown in Table 2, this process is remarkably effective for removing As, as well as for removing Sb.

TABLE 2

| ID | As | S | Sb | Pb |
|---|---|---|---|---|
| CaO 46-1 | 3281 | 6878 | 3181 | 4239 |
| CaO 46-2 | 2083 | 6454 | 2994 | 5200 |
| CaO 46-3 | 1180 | 4759 | 2822 | 5184 |
| CaO 46-4 | 981 | 2841 | 2511 | 4440 |
| CaO 46-5 | 407 | 2052 | 2584 | 5424 |
| CaO 46-6 | 208 | 1005 | 1977 | 5056 |
| CaO 46-7 | 126 | 645 | 1389 | 4878 |
| CaO 46-8 | 66 | 253 | 1044 | 2947 |
| CaO 46-9 | 42 | 174 | 767 | 2370 |

EXAMPLE 3

This experiment is provided to illustrate the properties of adding extra $CaSO_4$ as a source of lime to enhance removal of Sb. During this test, the temperature of the melt was controlled in the range of 1176–1206° C. Table 3 shows that S and As are preferentially removed into an initial slag formed from a mixture of $Na_2CO_3$/CaO. Antimony removal increases by 50% as soon as $CaSO_4$ is added. The exchange reactions between $CaSO_4$ and $Na_2O$ or $Na_2CO_3$ lead to the formation of more $Na_2SO_4$ and CaO in solution.

TABLE 3

| ID | As | S | Sb |
|---|---|---|---|
| CaO 56-1 | 3215 | 6454 | 5307 |
| CaO 56-2 | 3134 | 5370 | 5262 |
| CaO 56-3 | 1427 | 231 | 4600 |
| CaO 56-4 | 475 | 138 | 4005 |
| CaO 56-5 | 93 | 51 | 2668 |

EXAMPLE 4

About 149 MT of semi-blister copper having an initial composition as shown in Table 4 were fed into a pyrorefining vessel (PRV) (modified cylindrical converter). Subsequently, 3 MT of $Ca_2SO_4$ and 1 MT of $Na_2SO_4$ were added initially. Then 1.5 MT of CaO was injected at a rate of about 10 MT/hr while the oxygen in copper increased from 0.1 to 1 wt % and the temperature in the vessel was maintained between 1100 and 1220° C. After slag skimming, copper of the composition shown in table 4 was obtained. The percent elimination of impurities has also been included in the same table.

TABLE 4

| Charge 1519 | As | Bi | Ni | Pb | S | Sb | Se | Te |
|---|---|---|---|---|---|---|---|---|
| Initial (ppm) | 3200 | 310 | 2800 | 6600 | 5600 | 5870 | 1180 | 460 |
| final (ppm) | 44 | 125 | 1536 | 988 | 6 | 504 | 394 | 178 |
| % elimination | 99 | 60 | 45 | 85 | 100 | 91 | 67 | 61 |

This example is provided to show that a base slag of $Na_2SO_4$—$CaSO_4$ can be formed by directly adding these components. Subsequently, CaO is added to react with As and Sb. The percentage removal will depend on the CaO addition level. Since the sulphate slag produced is at low activity of copper oxide, as soon as the oxygen level in copper increases to saturation, two immiscible layers of slag co-exist. Thus, the formation of a CaO—$Cu_2O$ solution can be used to additionally enhance removal of Sb.

While the invention has been described in connection with specific embodiments thereof, it will be understood that the invention is capable of further modifications. This application is intended to cover any variations, uses or adaptations of the invention that generally follow the principles of the invention and including such departures from the present disclosure as come within known or customary practice within the art to which the invention pertains, and must be applied to the essential features hereinbefore set forth, and as follows in the scope of the appended claims.

What is claimed is:

1. A process for refining either blister copper or molten copper in a copper bath, containing at least S and optionally one or more elements selected from the group consisting of As, Sb, Pb, Ni, Bi, Se, and Te, comprising the steps of:

injecting a mixture of air and $O_2$ gas into the copper bath in the presence of an alkali source, and removing $SO_2$ generated in situ, thereby forming an effective amount of a molten alkali sulfate on top of the copper bath;

adding an alkali sulfate and/or alkali oxide into the melt to promote scrubbing of one or more elements selected from the group consisting of As and Sb into a solution containing sulfates;

increasing oxygen levels in the blister or molten copper to remove impurities one or more impurities selected from the group consisting of Sb, Pb, Ni, Bi, Se and Te by fluxing them into a molten solution of $Cu_2O$ and/or $Cu_2O$—CaO, the molten solution being stable with the sulfate phase; and removing slag from the copper bath.

2. A process according to claim 1, wherein the temperature is from about 1100° C. to 1300° C.

3. A process according to claim 1, wherein a dissolved oxygen level in the copper increases from about 0.1 to about 0.6 wt %.

4. A process according to claim 1, wherein the alkali oxides and sulfates are stable alkali or alkali earth compounds from Groups IA and IIA of the periodic table.

5. A process according to claim 1, wherein sulfates and $Cu_2O$—CaO solution coexist in two immiscible molten layers when the dissolved oxygen content in the copper is in the range of from 1 to 1.2 wt %.

6. A process according to claim 1, wherein mixtures of CaO and $Na_2CO_3$ are added to promote formation of a molten base slag of $Na_2SO_4$—$CaSO_4$, followed by adding an amount of CaO sufficient to remove As and Sb.

7. A process according to claim 1, wherein mixtures of $Na_2SO_4$—$CaSO_4$—CaO are added or co-injected to promote in situ formation of a CaO-saturated $Na_2SO_4$—$CaSO_4$ base slag to remove As and Sb.

8. A process according to claim 1, wherein a mixture of alkali oxides with sulfates is added, thereby causing at least one species in the copper bath selected from the group consisting of As and Sb to slag in the form of compound of a basic salt of arsenate and antimonate, and removing the thus-formed slag from the copper bath as liquid or solid phases.

9. A process according to claim 1, wherein each step is practised separately or in any combination thereof either in a batch, semi-continuous, or continuous operation.

10. A process according to claim 1, wherein each step is carried out or adapted to any one of a ladle station vessel configuration, a vertical vessel configuration, or a cylindrical vessel configuration.

* * * * *

UNITED STATES PATENT AND TRADEMARK OFFICE

CERTIFICATE OF CORRECTION

PATENT NO. : 6,395,059 B1
DATED : May 28, 2002
INVENTOR(S) : Zamalloa et al.

It is certified that error appears in the above-identified patent and that said Letters Patent is hereby corrected as shown below:

Column 10,
Line 28, the word "impurities" after the word "remove" must be deleted.

Signed and Sealed this

Twenty-third Day of December, 2003

JAMES E. ROGAN
*Director of the United States Patent and Trademark Office*